US010786996B2

(12) United States Patent
Kohda

(10) Patent No.: US 10,786,996 B2
(45) Date of Patent: Sep. 29, 2020

(54) LIQUID DISCHARGE HEAD, LIQUID DISCHARGE DEVICE, AND LIQUID DISCHARGE APPARATUS

(71) Applicant: Tomohiko Kohda, Ibaraki (JP)

(72) Inventor: Tomohiko Kohda, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 40 days.

(21) Appl. No.: 16/354,223

(22) Filed: Mar. 15, 2019

(65) Prior Publication Data

US 2019/0283436 A1 Sep. 19, 2019

(30) Foreign Application Priority Data

Mar. 16, 2018 (JP) ..... 2018-049963

(51) Int. Cl.
*B41J 2/14* (2006.01)
*B41J 2/175* (2006.01)

(52) U.S. Cl.
CPC ..... *B41J 2/17513* (2013.01); *B41J 2/1433* (2013.01); *B41J 2/14233* (2013.01); *B41J 2/14274* (2013.01); *B41J 2/17563* (2013.01); *B41J 2002/14306* (2013.01)

(58) Field of Classification Search
CPC .. B41J 2/17513; B41J 2/14233; B41J 2/1433; B41J 2/14274; B41J 2002/14306; B41J 2/17563; B41J 2002/14419; B41J 2002/14362
See application file for complete search history.

(56) References Cited

U.S. PATENT DOCUMENTS

2006/0012647 A1 1/2006 Yamada et al.
2010/0328409 A1 12/2010 Matsufuji et al.
2014/0009544 A1 1/2014 Koda
2015/0077469 A1 3/2015 Kohda et al.
(Continued)

FOREIGN PATENT DOCUMENTS

JP 2006-035807 2/2006
JP 2007-145014 6/2007
JP 2010-188547 9/2010
(Continued)

OTHER PUBLICATIONS

Machine translation of JP-2012192641, published on Oct. 2012. (Year: 2012).*

(Continued)

*Primary Examiner* — Huan H Tran
(74) *Attorney, Agent, or Firm* — Oblon, McClelland, Maier & Neustadt, L.L.P.

(57) ABSTRACT

A liquid discharge head includes a channel section, and a driving section. The channel section supplies a liquid to a plurality of nozzles to discharge the liquid. The driving section causes the nozzles to discharge the liquid. The channel section includes an individual chamber to supply the liquid to the nozzles and a common chamber to supply the liquid to the individual chamber. A laminated portion of each of a plurality of plate-shaped components which are constituent components of the individual chamber does not have a cut-out portion in a portion corresponding to a bonding position of a damper member disposed between the individual chamber and the common chamber.

18 Claims, 14 Drawing Sheets

(56) References Cited

U.S. PATENT DOCUMENTS

2017/0129245 A1 5/2017 Kohda et al.

FOREIGN PATENT DOCUMENTS

| | | |
|---|---|---|
| JP | 2010-201781 | 9/2010 |
| JP | 2012-183771 | 9/2012 |
| JP | 2012-192641 | 10/2012 |
| JP | 2013-063551 | 4/2013 |
| JP | 2013-063552 | 4/2013 |
| JP | 2014-104622 | 6/2014 |
| JP | 2014-162157 | 9/2014 |
| JP | 2014-162160 | 9/2014 |
| JP | 2014-172176 | 9/2014 |
| JP | 2015-150687 | 8/2015 |
| JP | 2017-132237 | 8/2017 |
| JP | 2017-164922 | 9/2017 |

OTHER PUBLICATIONS

Machine translation of JP-2007145014, published on Jun. 2007 (Year: 2007).*
Machine translation of JP-2017164922, published on Sep. 2017 (Year: 2017).*
Machine translation of JP-2017132237, published on Aug. 2017 (Year: 2017).*
Machine translation of JP-2014172176, published on Sep. 2014 (Year: 2014).*
Machine translation of JP-2014162160, published on Sep. 2014 (Year: 2014).*
Machine translation of JP-2014162157, published on Sep. 2014 (Year: 2014).*

* cited by examiner

LIQUID DISCHARGE HEAD, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-049963, filed on Mar. 16, 2018, in the Japan Patent Office, the entire disclosure of which is incorporated by reference herein.

BACKGROUND

Technical Field

The present invention relates to a liquid discharge head, a liquid discharge device, and a liquid discharge apparatus.

Related Art

As an image forming apparatus for forming an image or the like, an apparatus including a liquid discharge device having a liquid discharge head for discharging a liquid ink for discharging a liquid ink onto a medium to form an image or the like is known. Such an apparatus is a type of "liquid discharge apparatus". The liquid discharge head included in the apparatus includes: a pressure chamber having a plurality of nozzles serving as discharge ports of a liquid for supplying an ink to each of the nozzles; a common ink chamber for distributing an ink from an ink supply source to the plurality of pressure chambers via an ink supply hole; and a plurality of pressure generators corresponding to the respective pressure chambers. Discharge energy applied to the pressure chamber by the pressure generator causes pressure fluctuation in a liquid ink in the pressure chamber. As a result, the liquid discharge head having the above configuration operates so as to discharge the liquid ink from the nozzles. The pressure fluctuation caused in the pressure chamber is propagated to a common chamber and may also be propagated to another adjacent pressure chamber via the common chamber.

When the pressure fluctuation is propagated to an adjacent pressure chamber (individual chamber), "mutual interference" affecting liquid discharge characteristics in another pressure chamber occurs. Mutual interference causes leakage of ink droplets from each nozzle, unintentional ink discharge, and the like. That is, unintentional leakage of ink droplets from a nozzle not involved in control of operation of the liquid discharge head, or the like occurs. When a discharge state is unstable in this manner, high-quality ink discharge control cannot be performed as a result. In this case, in the image forming apparatus including the ink discharge head, image formation quality may be deteriorated.

In order to prevent propagation of pressure fluctuation as described above, a structure absorbing pressure fluctuation may be used between the common chamber and the individual chamber. For example, a liquid discharge head is known that has a configuration in which a damper is disposed between a common chamber and an individual chamber to prevent propagation of pressure fluctuation.

SUMMARY

In an aspect of the present disclosure, there is provided a liquid discharge head that includes a channel section, and a driving section. The channel section supplies a liquid to a plurality of nozzles to discharge the liquid. The driving section causes the nozzles to discharge the liquid. The channel section includes an individual chamber to supply the liquid to the nozzles and a common chamber to supply the liquid to the individual chamber. A laminated portion of each of a plurality of plate-shaped components which are constituent components of the individual chamber does not have a cut-out portion in a portion corresponding to a bonding position of a damper member disposed between the individual chamber and the common chamber.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
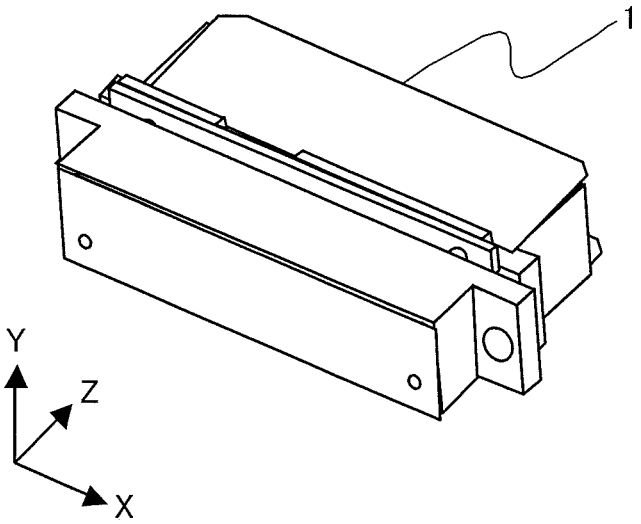
FIG. 1 is a perspective view of a liquid discharge head according to an embodiment of the present invention.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

One gist of the present invention is that a liquid discharge head according to an embodiment of the present invention has a structure in which a damper and an individual chamber are formed on different planes, a hollow region is not formed below the damper, and a member forming the individual chamber does not have an unpressurized region.

Note that the "liquid discharge head" is a functional component for discharging and jetting a liquid from a nozzle. A liquid to be discharged may be any liquid as long as having a viscosity and surface tension that can be discharged from a head, and is not particularly limited, but preferably has a viscosity of 30 mPa·s or less at ordinary temperature and normal pressure or by heating or cooling. More specifically, the liquid to be discharged is a solution, a suspension liquid, an emulsion, or the like containing a solvent such as water or an organic solvent, a colorant such as a dye or a pigment, a function-imparting material such as a polymerizable compound, a resin, or a surfactant, a biocompatible material such as deoxyribonucleic acid (DNA), amino acid, protein, or calcium, or an edible material such as a natural pigment, which can be used, for example, for an inkjet ink, a surface treatment liquid, a liquid for forming a constituent element of an electronic element or a light emitting element or an electronic circuit resist pattern, a three-dimensional modeling material liquid, or the like.

Examples of an energy generation source for discharging a liquid include those using a piezoelectric actuator (a laminated type piezoelectric element and a thin film type piezoelectric element), a thermal actuator using an electrothermal transducer such as a heating resistor, and an electrostatic actuator including a diaphragm and a counter electrode.

First Embodiment

Hereinafter, an embodiment of the present invention will be described with reference to the drawings. FIG. 1 is a view illustrating an external structure of a liquid discharge head 1 according to the present embodiment. Based on the coordinate axes of the three-dimensional orthogonal coordinate system illustrated in FIG. 1, nozzles 20 serving as ink discharge ports included in the liquid discharge head 1 are arranged on a plane parallel to the YZ plane. That is, FIG. 1 is a perspective view as seen from the ink discharge port of the liquid discharge head 1.

Figure 2:
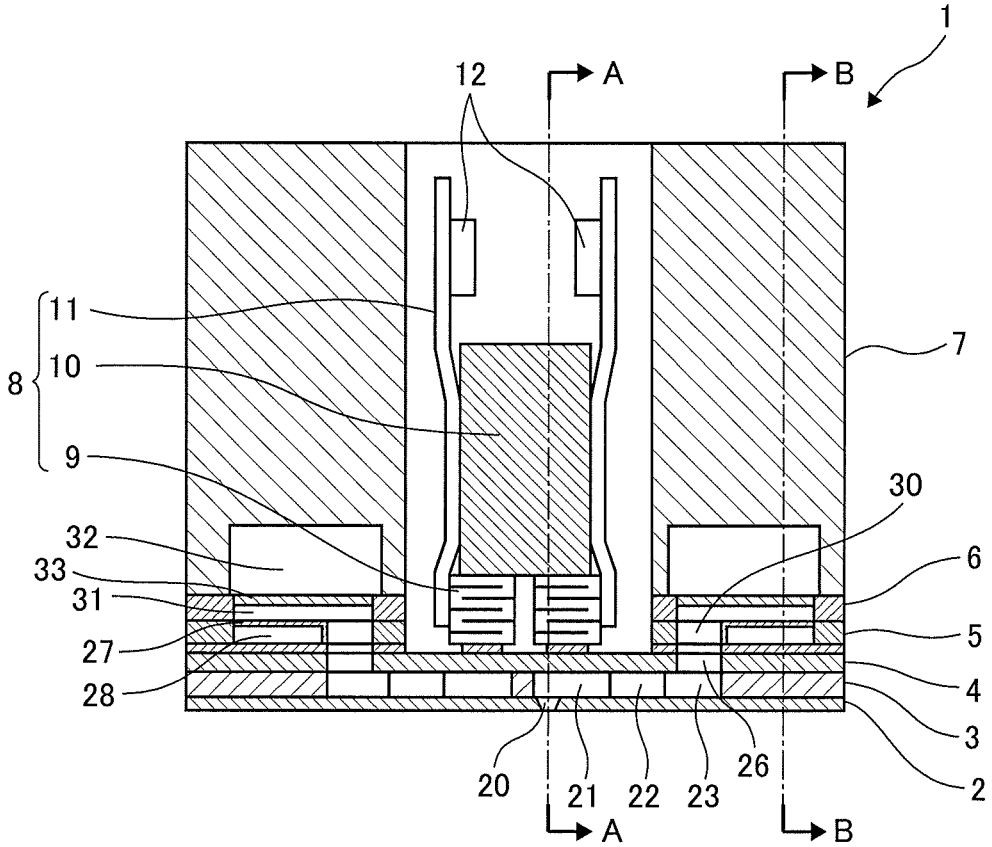
FIG. 2 is a cross-sectional view of the liquid discharge head according to the above embodiment.

FIG. 2 is a YZ cross-sectional view illustrating an internal structure of the liquid discharge head 1. As described later, the liquid discharge head 1 includes a nozzle row formed by arranging the plurality of nozzles 20 in two rows. The plurality of nozzles 20 has an ink supply channel for supplying an ink to each of the nozzles 20.

The ink supply channel which is an ink channel is formed by a common chamber and an individual chamber. The individual chamber for supplying an ink to each of the nozzles 20 is formed by a nozzle plate 2, a chamber plate 3, and a diaphragm plate 4. An ink supplied from the common chamber to the individual chamber reaches a pressure chamber 21 of the chamber plate 3 via the diaphragm plate 4. When a piezoelectric element 9 changes the volume of the pressure chamber 21 to cause pressure fluctuation, an ink is discharged from the nozzles 20 formed in the nozzle plate 2 due to this pressure fluctuation. The configuration of the liquid discharge head 1 is roughly classified into a channel section and a driving section 8. The channel section constitutes the ink supply channel formed by the common chamber and the individual chamber such that an ink reaches the nozzles 20. The driving section 8 generates discharge energy for discharging an ink from the nozzles 20 and pressurizes the pressure chamber 21.

The channel section includes the nozzle plate 2, the chamber plate 3, the diaphragm plate 4, a damper plate 5 which is a damper component, and a filter plate 6. The nozzle plate 2 has the nozzles 20 formed therein. The chamber plate 3 is laminated on the nozzle plate 2 to form the pressure chamber 21, a fluid restrictor 22, and an introduction channel 23. The introduction channel 23 formed in the chamber plate 3 corresponds to an ink introduction space for introducing an ink from an under-filter common chamber 31 to the pressure chamber 21.

The diaphragm plate 4 includes a diaphragm 24 laminated on the chamber plate 3 for changing the volume of the pressure chamber 21, an island 25, and a communication hole 26. The detailed configuration of the diaphragm plate 4 will be described later. The damper plate 5 which is a damper member is laminated on the diaphragm plate 4 to form a damper 27, an air release chamber 28, an air communication channel 29, and a second introduction channel 30. The filter plate 6 is laminated on the damper plate 5. The filter plate 6 includes a filter 33.

In the channel section, a portion where the nozzle plate 2, the chamber plate 3, and the diaphragm plate 4 are laminated and bonded to each other (laminated portion) does not have a cut-out portion (including a hole) forming the damper 27. That is, the channel section has characteristics in bonding positions of components (plate-shaped members) constituting the channel section. Specifically, there is no space such as a hole in a portion (corresponding to the above laminated portion) corresponding to a position where the damper plate 5 which is a damper member at bonding positions of the components is disposed. In other words, the channel section does not have a space in a bonding portion such as a cut-out portion in bonding portions of the components corresponding to a portion bonded to the damper plate 5 in portions where the above components are laminated and bonded to each other. As a result, the channel section according to the present embodiment has a structure that does not generate a difference in rigidity due to a bonding state of constituent components constituting a channel for supplying an ink to the nozzles 20. That is, the difference in rigidity due to the bonding state of the components constituting the channel can be uniform.

A frame 7 is bonded to the filter plate 6 to form a common chamber. An upstream side (side of the frame 7) of the filter 33 included in the filter plate 6 is referred to as an over-filter common chamber 32. A downstream side (side of the damper plate 5) of the filter 33 included in the filter plate 6 is referred to as the under-filter common chamber 31. The common chamber is divided into an upper portion and a lower portion by the filter 33 included in the filter plate 6.

Next, a material of each component and a manufacturing method will be described. The nozzle plate 2 is made of a stainless steel material (steel use stainless (SUS) 316) and is a plate-shaped component in which the nozzles 20 are formed by pressing. The chamber plate 3 is also made of a stainless steel material (SUS 316) and is a plate-shaped component in which the pressure chamber 21 through which an ink flows, the fluid restrictor 22, and the introduction channel 23 are formed by pressing. The diaphragm plate 4 is made of nickel (Ni) or a nickel alloy (Ni alloy) and is a plate-shaped component formed by electroforming. The diaphragm 24 (see FIG. 6) formed on the diaphragm plate 4 serves as a wall of the pressure chamber 21. The diaphragm 24 changes the volume of the pressure chamber 21. The island (see FIG. 6) formed in the diaphragm plate 4 is located substantially at the center of the diaphragm 24 and efficiently propagates a displacement of the diaphragm 24.

The damper plate 5 is made of nickel (Ni) or a nickel alloy (Ni alloy) and is formed by electroforming. A growing direction of electroforming in the damper plate 5 is a direction toward the nozzles 20. Note that the thickness of a thin plate portion of the damper plate 5 acting as the damper 27 is about 2 to 4 micrometers. The thickness of the damper plate 5 around the portion acting as the damper 27 (the thickness of a portion surrounding the damper 27) is about 7 to 20 micrometers.

The filter plate 6 is made of nickel (Ni) or a nickel alloy (Ni alloy) and is formed by electroforming. The thickness of the filter plate 6 is about 2 to 4 micrometers, and a part of the filter plate 6 has numerous holes. The diameter of each of these holes is about 60% to 90% of the diameter of each of the nozzles 20. These holes are arranged in a bale stacking form.

The frame 7 is made of a stainless steel material (SUS 303). The common chamber formed between the frame 7 and the filter plate 6 is formed by machining a corresponding portion of the frame 7.

Next, the configuration of the driving section 8 will be described. As illustrated in FIG. 2, the driving section 8 includes the piezoelectric element 9 for generating a pressure to deform the diaphragm 24, a base 10 holding the piezoelectric element 9, and flexible printed circuits (FPC) 11 including a circuit for applying an electric signal to the piezoelectric element 9.

The piezoelectric element 9 is made of lead zirconate titanate (piezoelectric transducer (PZT)), and transducers for pressurizing the diaphragm 24 are disposed in the piezoelectric element 9 by dicing such that the number of the transducers is twice or more the number of the nozzles 20. The base 10 is made of a stainless steel material (SUS 430) and is formed by machining. The FPC 11 includes a substrate formed of polyimide and copper foil and a driver IC 12 for selecting a drive channel disposed on the substrate.

Figure 3:
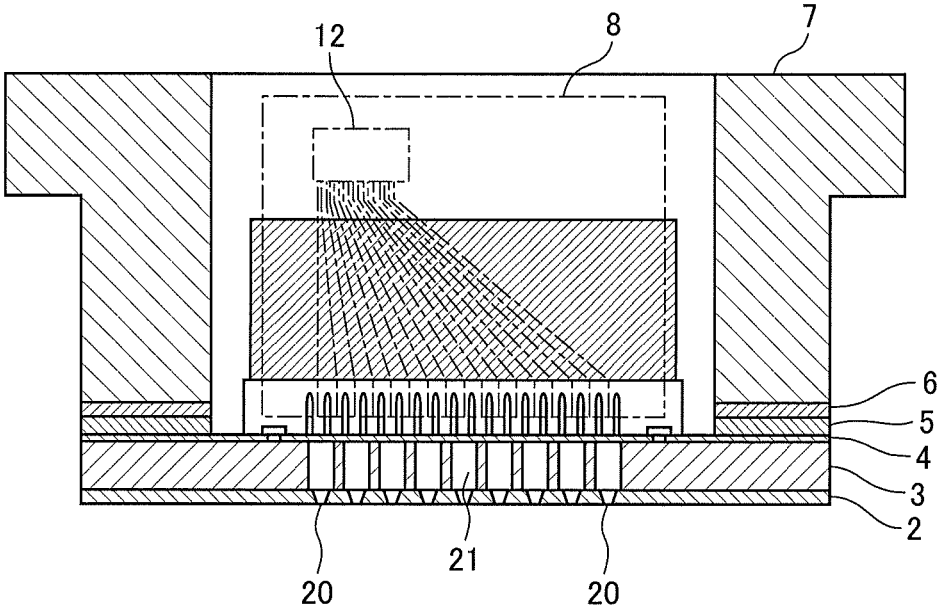
FIG. 3 is a cross-sectional view of FIG. 2 taken along line A-A.

FIG. 3 is a cross-sectional view of FIG. 2 taken along line A-A. As illustrated in FIG. 3, the driver integrated circuit (IC) 12 included in the driving section 8 is coupled to the diaphragm 24 of the diaphragm plate 4, and operates such that each of the diaphragms 24 applies a pressure to the pressure chamber 21 by operation control by the driver IC 12. That is, the driving section 8 applies a pressure to the pressure chamber 21 via the diaphragm 24 to discharge an ink from the nozzles 20.

Figure 4:
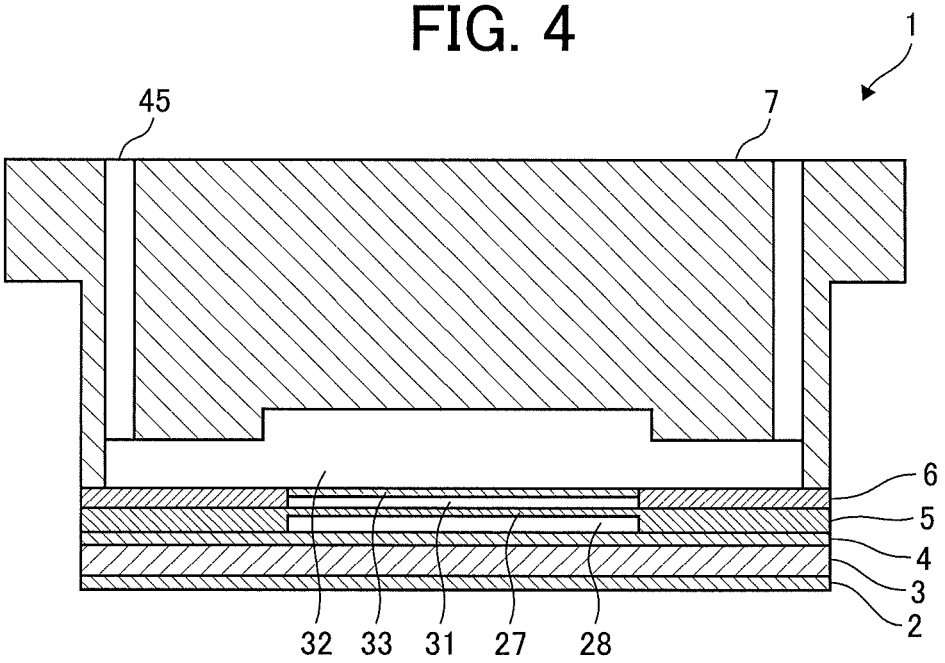
FIG. 4 is a cross-sectional view of FIG. 2 taken along line B-B.

FIG. 4 is a cross-sectional view of FIG. 2 taken along line B-B. As illustrated in FIG. 4, an ink supply hole 45 communicates with the over-filter common chamber 32, and an ink is supplied from the ink supply hole 45. The ink supplied to the over-filter common chamber 32 is filtered by the filter 33 included in the filter plate 6 and moves to the under-filter common chamber 31 formed below the filter 33. The under-filter common chamber 31 has substantially the same width as the nozzle row. The ink is supplied from the under-filter common chamber 31 to the pressure chamber 21 via the second introduction channel 30 or the like. As in the configuration described above, in the liquid discharge head 1, a plurality of plate-shaped components is laminated and bonded to form the common chamber and the individual chamber.

Figure 5:
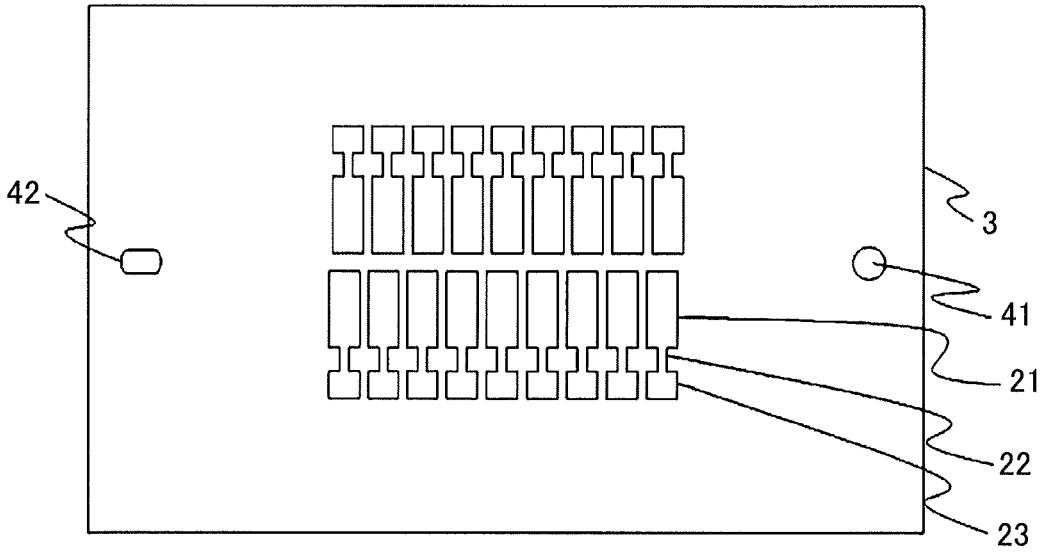
FIG. 5 is a plan view of a chamber plate constituting the liquid discharge head according to the present embodiment.

Next, each of members constituting the liquid discharge head 1 will be described in more detail. First, the chamber plate 3 according to the present embodiment will be described. As illustrated in FIG. 5, in the chamber plate 3, the pressure chambers 21 are arranged in two rows in accordance with the row (nozzle row) of the nozzles 20 formed in the nozzle plate 2. In the chamber plate 3, the fluid restrictor 22 and the introduction channel 23 are also formed so as to follow the pressure chamber 21. The chamber plate 3 has a reference hole 41 and a reference elongated hole 42 used for positioning when the chamber plate 3 is bonded to the nozzle plate 2 and the diaphragm plate 4.

Figure 6:
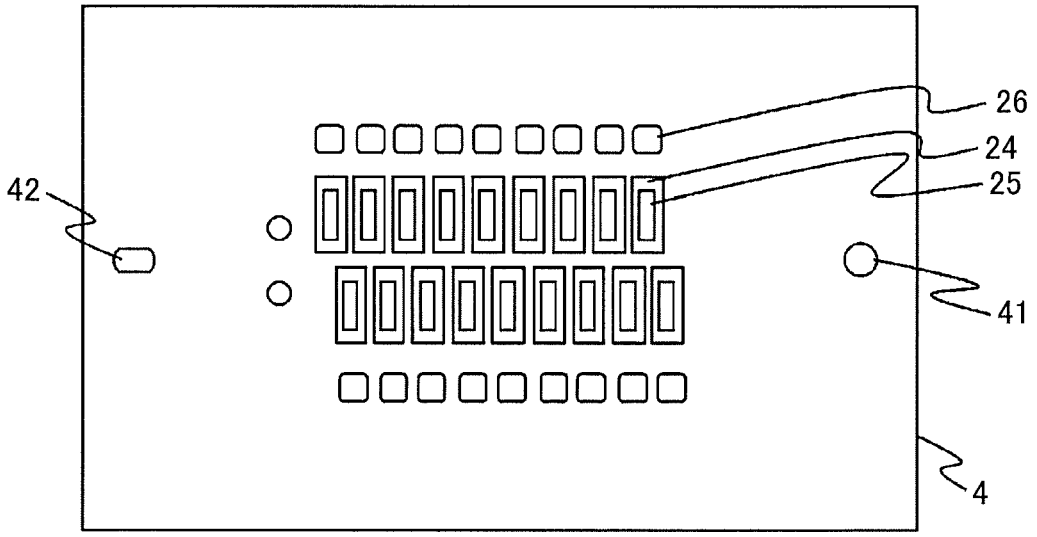
FIG. 6 is a plan view of a diaphragm plate constituting the liquid discharge head according to the present embodiment.

Next, the diaphragm plate 4 will be described. As illustrated in FIG. 6, in the diaphragm plate 4, the diaphragms 24 are arranged at positions corresponding to the pressure chambers 21 of the chamber plate 3. A communication hole 26 is formed outside the diaphragm 24 at a position following the introduction channel 23 of the nozzle plate 2. Like the chamber plate 3, the diaphragm plate 4 has the reference hole 41 and the reference elongated hole 42 used for positioning when the diaphragm plate 4 is bonded to other members.

Figure 7A:
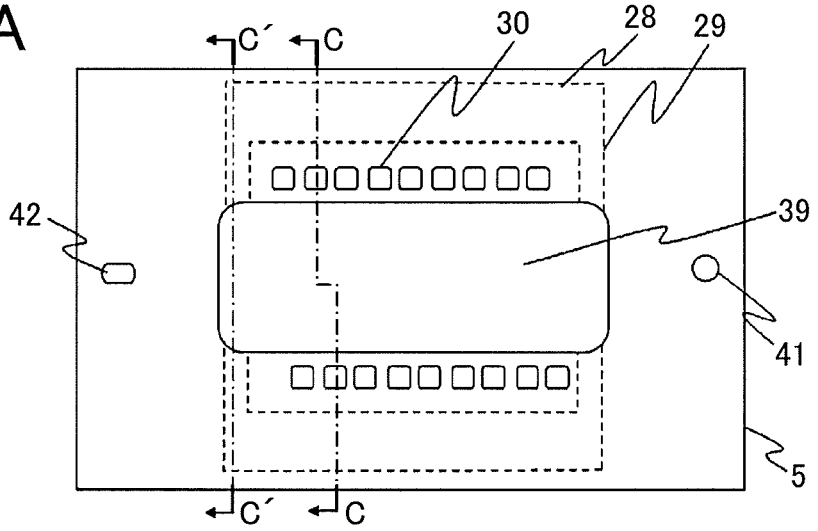
FIGS. 7A to 7C are a plan view of a damper plate constituting the liquid discharge head according to the present embodiment, a cross-sectional view thereof taken along line C-C, and a cross sectional view thereof taken along line C'-C', respectively.

Next, the damper plate 5 will be described. As illustrated in FIG. 7A, an opening (ACT opening 39) which is a space where the driving section 8 is disposed is formed at the center of the damper plate 5 in plan view. The air release chamber 28 is formed around the ACT opening 39 as a center. A plurality of the second introduction channels 30 is formed around the ACT opening 39 at positions following the communication holes 26.

Figure 7B:
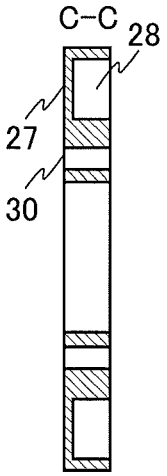
Figure 7C:
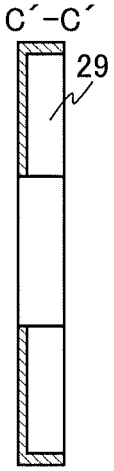

FIG. 7B is a cross-sectional view of FIG. 7A taken along line C-C. As illustrated in FIG. 7B, a portion where the air release chamber 28 is formed corresponds to a portion where the damper 27 is formed by the damper plate 5. The damper 27 is formed by a thin plate portion in which the thickness of the damper plate 5 is reduced. The air release chamber 28 is located on a back side of the thin plate portion in which the damper 27 is formed. FIG. 7C is a cross-sectional view of FIG. 7A taken along line C'-C'. As illustrated in FIG. 7C, the air release chamber 28 communicates with the ACT opening 39 via the air communication channel 29 outside a portion where the second introduction channels 30 are arranged.

As illustrated in FIG. 7A, a region surrounded by a broken line indicating the air communication channel 29 indicates a contour of a projection surface obtained by projecting the damper 27 formed by the damper plate 5 onto components (nozzle plate 2, chamber plate 3, and diaphragm plate 4) constituting the individual chamber. The whole of the region indicated by this broken line has no unpressurized region of the components constituting the individual chamber. That is, the whole of the region is pressurized.

Figure 8A:
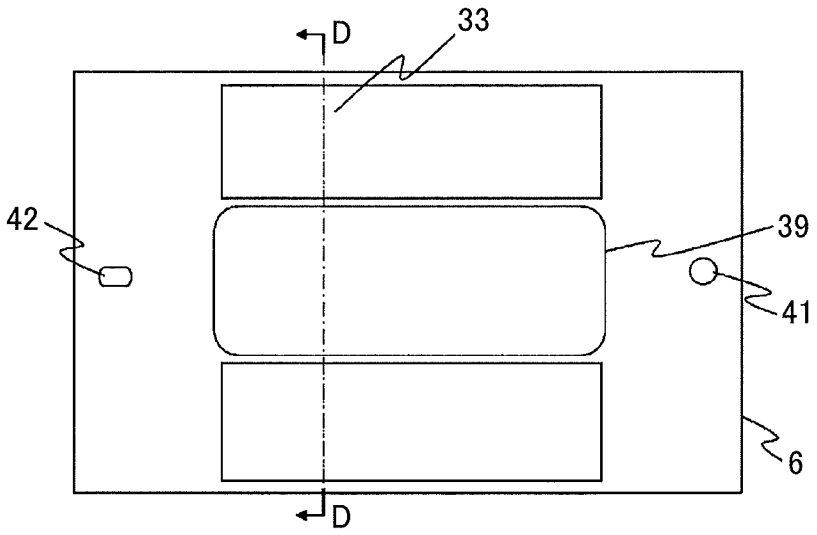
FIGS. 8A and 8B are a plan view of a filter plate constituting the liquid discharge head according to the present embodiment and a cross-sectional view thereof taken along line D-D, respectively.
Figure 8B:
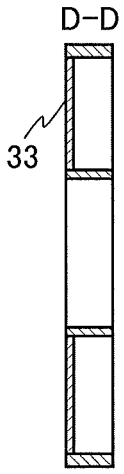

Next, the filter plate 6 will be described. As illustrated in FIG. 8A, in the filter plate 6, the filter 33 is disposed around the ACT opening 39 as a center. FIG. 8B is a cross-sectional view of FIG. 8A taken along line D-D. As illustrated in FIG. 8B, the under-filter common chamber 31 is formed by a partition surrounding the filter 33.

By laminating the above components, the damper 27 is formed so as not to be disposed on the same plane as the components (nozzle plate 2, chamber plate 3, and diaphragm plate 4) constituting the individual chamber. The damper 27 is disposed on an upstream side of an ink channel (communication hole 26 and second introduction channel 30). Furthermore, the projection surface obtained by projecting the damper 27 onto the components constituting the individual chamber has no unpressurized region. That is, the member constituting the individual chamber is formed in a state where the whole region onto which the damper 27 is projected is pressurized.

In the liquid discharge head 1 having the above configuration according to the present embodiment, a component forming the pressure chamber 21 does not form a cavity or an unbonded portion in the laminated portion where the individual chamber-constituting components are laminated below the common chamber, and high rigidity can be secured. The damper 27 is disposed below the filter 33 and above the components (nozzle plate 2, chamber plate 3, and diaphragm plate 4) constituting the individual chamber. As a result, it is possible to suppress propagation of pulsation due to pressure fluctuation caused by pressurization to the pressure chamber 21 to an adjacent common chamber, and to suppress propagation of pulsation to another pressure chamber 21. By virtue of these effects, it is possible to suppress a vibration generated in a channel component as much as possible, and unnecessary disturbance does not occur to the nozzles 20. Therefore, variation in discharge speed is small, and stable discharging performance can be obtained.

Second Embodiment

Figure 9:
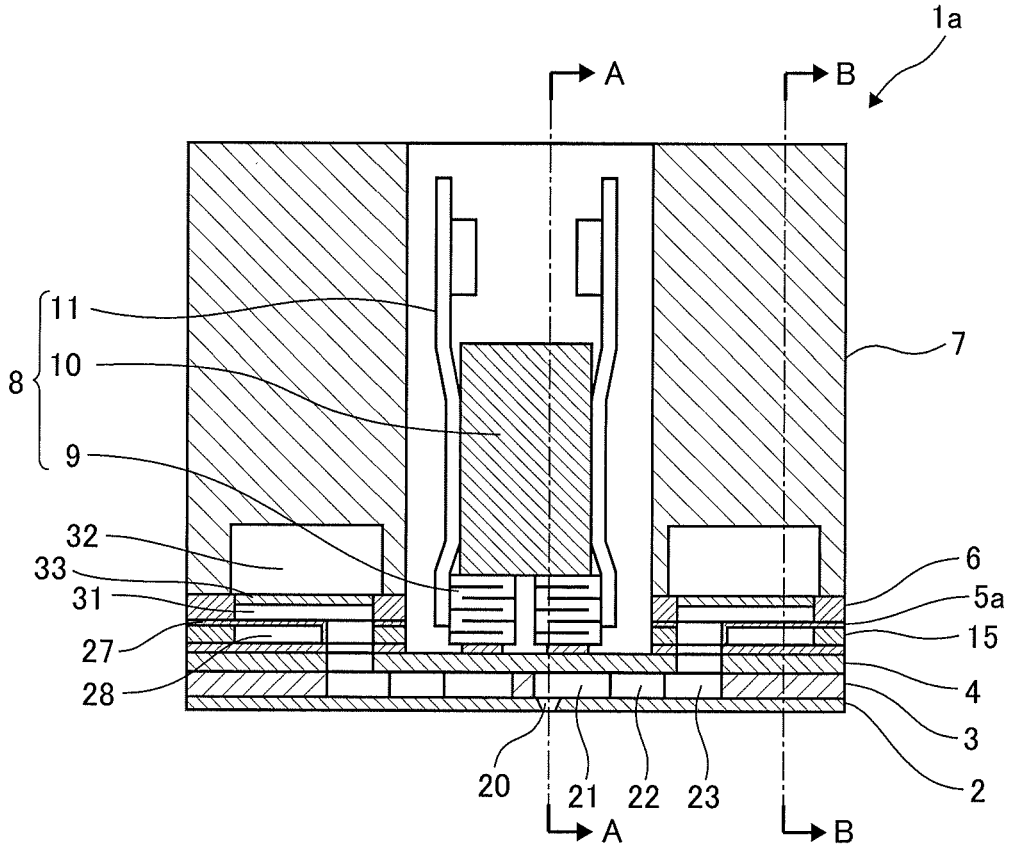
FIG. 9 is a perspective view of a liquid discharge head according to another embodiment of the present invention.

Next, a liquid discharge head according to another embodiment of the present invention will be described. FIG. 9 is a cross-sectional view for explaining an internal structure of a liquid discharge head 1*a* according to the present embodiment. Like the liquid discharge head 1, the liquid discharge head 1*a* includes a nozzle row in which a plurality of nozzles 20 is arranged in two rows. The plurality of nozzles 20 has an independent ink supply channel for supplying an ink to each of the nozzles 20. Note that the liquid discharge head 1*a* is common to the liquid discharge head 1 in that a damper 27 is disposed above components (nozzle plate 2, chamber plate 3, and diaphragm plate 4) constituting a common chamber. Meanwhile, the liquid discharge head 1*a* has a different configuration from the liquid discharge head 1 in that the liquid discharge head 1*a* includes not only a damper plate 5 but also a thin plate-shaped damper plate 5*a* and a spacer plate 15 as a damper component forming an air release chamber 28. The spacer plate 15 is a plate-shaped component disposed between the damper plate 5 and the diaphragm plate 4. Incidentally, in the following description, a detailed description of components common to the liquid discharge head 1 will be omitted.

Figure 10A:
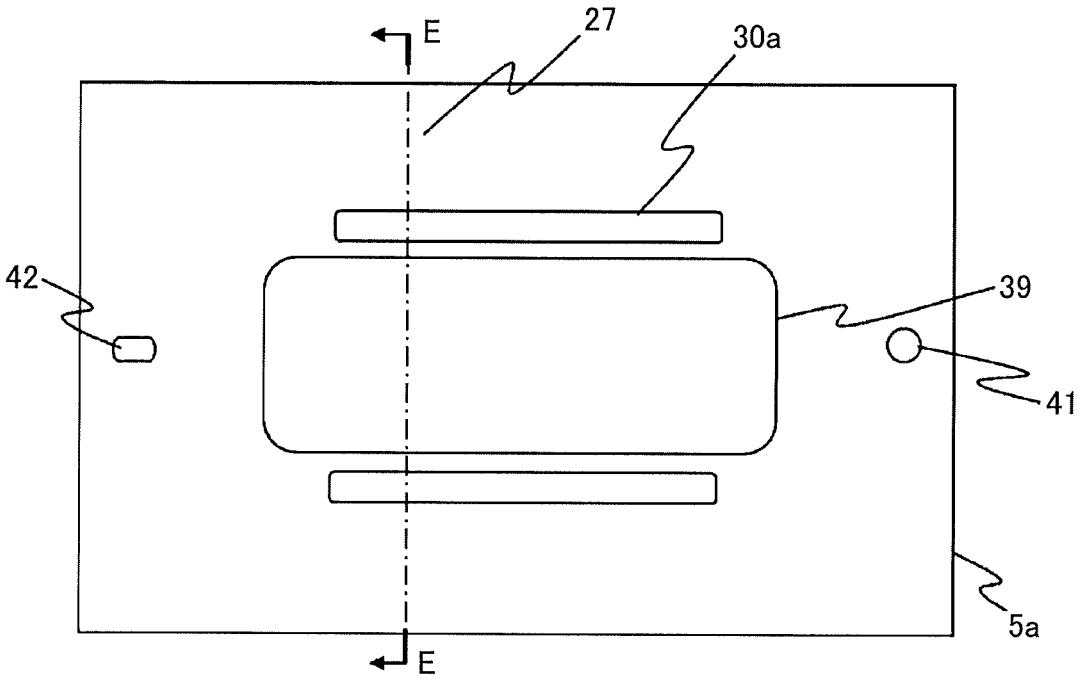
FIGS. 10A and 10B are a plan view of a damper plate constituting the liquid discharge head according to the other embodiment and a cross-sectional view thereof taken along line E-E, respectively.
Figure 10B:
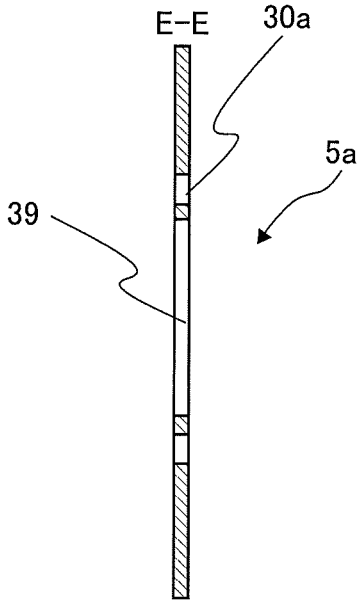

FIG. 10A is a plan view of the damper plate 5*a*, and FIG. 10B is a cross-sectional view of FIG. 10A taken along line E-E. As illustrated in FIGS. 10A and 10B, the damper plate 5*a* according to the present embodiment is formed of a single flat plate. This increases the degree of freedom in a method for processing the damper plate 5*a*, a material thereof, or the like. As a result, for example, a polyimide film or the like can be selected as a material to form the damper plate 5*a*. Note that the damper plate 5*a* has a rectangular outer shape, and an ACT opening 39 which is a rectangular opening having a long side in a longitudinal direction of the damper plate 5*a* is formed at the center of the damper plate 5*a*. An elongated second introduction channel 30*a* is formed along the long side of the ACT opening 39. That is, unlike the second introduction channel 30 of the damper plate 5 according to the first embodiment, the second introduction channel 30*a* is not separately disposed for each of the nozzle 20.

Figure 11A:
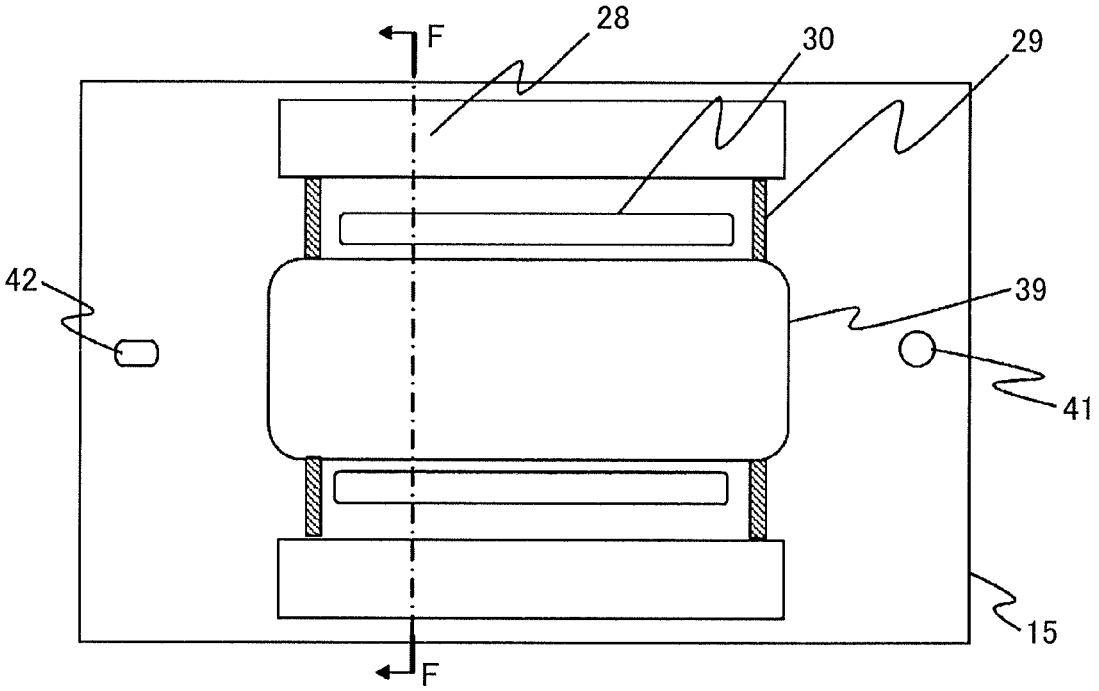
FIGS. 11A and 11B are a plan view of a spacer plate constituting the liquid discharge head according to the other embodiment and a cross-sectional view thereof taken along line F-F, respectively.
Figure 11B:
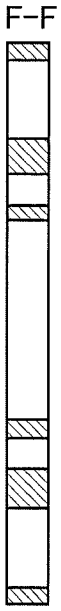

Next, the spacer plate 15 according to the present embodiment will be described with reference to FIGS. 11A and 11B. FIG. 11A is a plan view of the spacer plate 15, and FIG. 11B is a cross-sectional view of FIG. 11A taken along line F-F. The spacer plate 15 is formed by etching or electroforming a stainless steel material (SUS). The liquid discharge head 1*a* according to the second embodiment has a configuration in which the air release chamber 28 is disposed substantially directly under the damper 27. Therefore, the second introduction channel 30 for air release is formed by half etching or double layer electroforming.

With the above configuration, an adhesive between the damper plate 5*a* and the spacer plate 15 serves as a cushioning material. With this cushioning material, it is possible to further reduce an influence of vibration (pulsation) due to pressure fluctuation propagated to an individual chamber. The liquid discharge head 1*a* according to the present embodiment can suppress pulsation of a common chamber with the damper 27, and to reduce a bad influence of the pulsation on discharging performance from the nozzles 20 in the components constituting the individual chamber. That is, variation in discharge speed from the nozzles 20 can be reduced.

Third Embodiment

Figure 12:
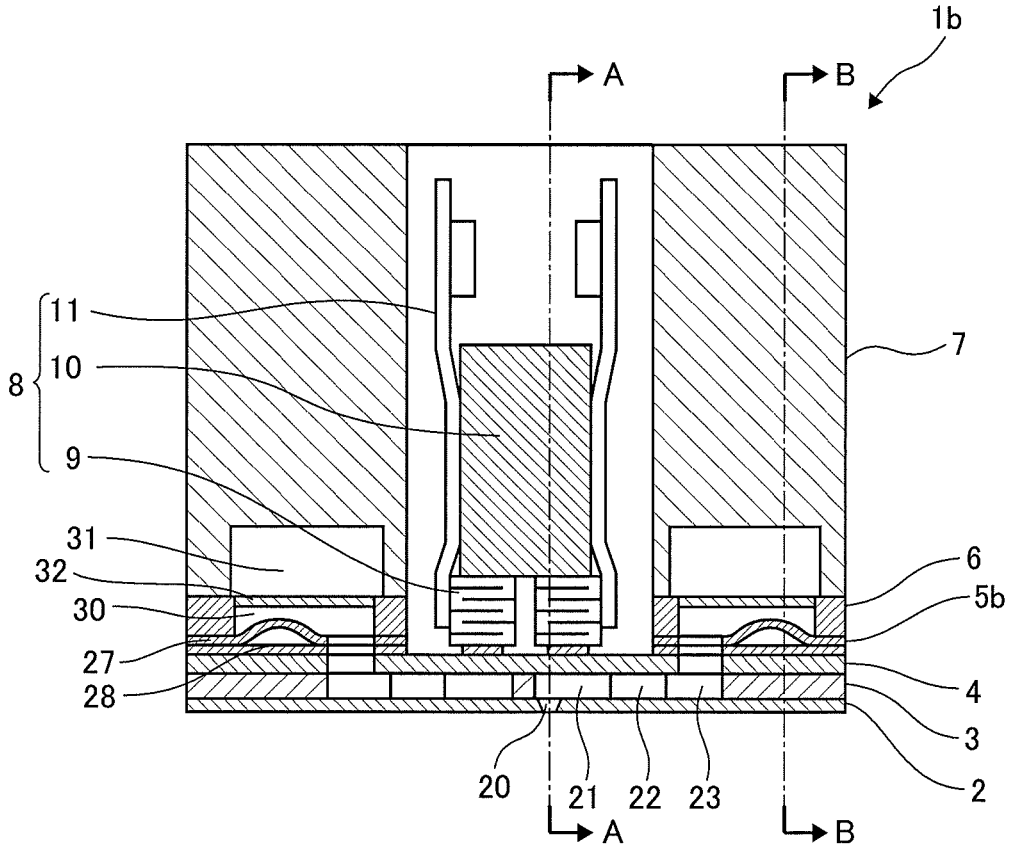
FIG. 12 is a perspective view of a liquid discharge head according to still another embodiment of the present invention.

Next, a liquid discharge head according to still another embodiment of the present invention will be described. FIG. 12 is a cross-sectional view for explaining an internal structure of a liquid discharge head 1*b* according to the present embodiment. The liquid discharge head 1*b* is configured using components common to the liquid discharge head 1 and the liquid discharge head 1*a* described above. Detailed description of the same components as the components that have been described will be omitted. The liquid discharge head 1*b* according to the present embodiment does not use a spacer plate 15 but uses a damper plate 5*b* having a plate warped portion obtained by deforming a part of a damper plate 5 as a damper component. The damper plate 5*b* is a component obtained by deforming a portion acting as a damper 27 in the damper plate 5, and an air release chamber 28 is formed in this deformed portion.

Figure 13A:
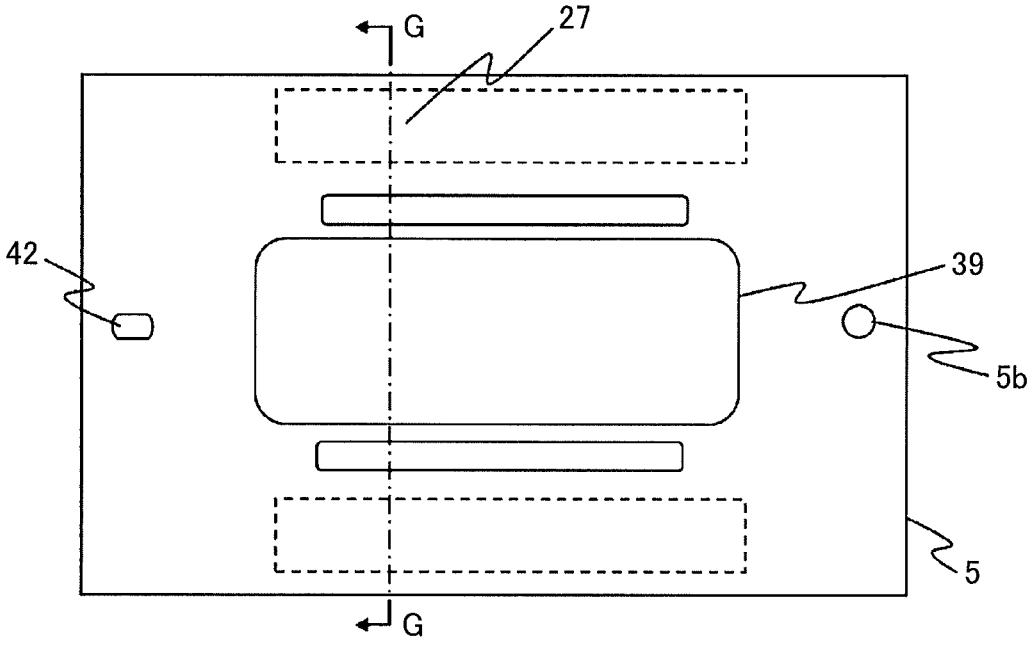
FIGS. 13A and 13B are a plan view of a damper plate constituting the liquid discharge head according to the still another embodiment and a cross-sectional view thereof taken along line G-G, respectively.
Figure 13B:
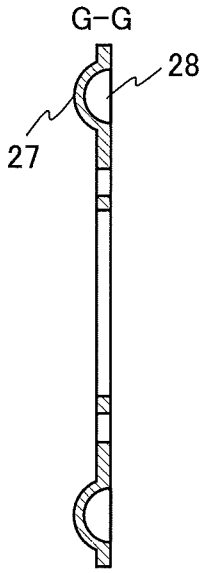

With reference to FIGS. 13A and 13B, the damper plate 5*b* according to the present embodiment will be described. FIG. 13A is a plan view of the damper plate 5*b*. FIG. 13B is a cross-sectional view of FIG. 13A taken along line G-G. The damper plate 5*b* according to the present embodiment is a plate-shaped component formed by electroforming or with a thin film of a stainless steel material (SUS). In the damper plate 5*b*, a predetermined portion of an object once formed into a plate shape is plastically deformed using a pressing jig to form a plate warped portion, and the air release chamber 28 is formed in this plate warped portion. As illustrated in FIG. 13B, the air release chamber 28 is located on a side of a common chamber of the plate warped portion in which a portion acting as the damper 27 has a shape along a direction of the under-filter common chamber 31.

Figure 14:
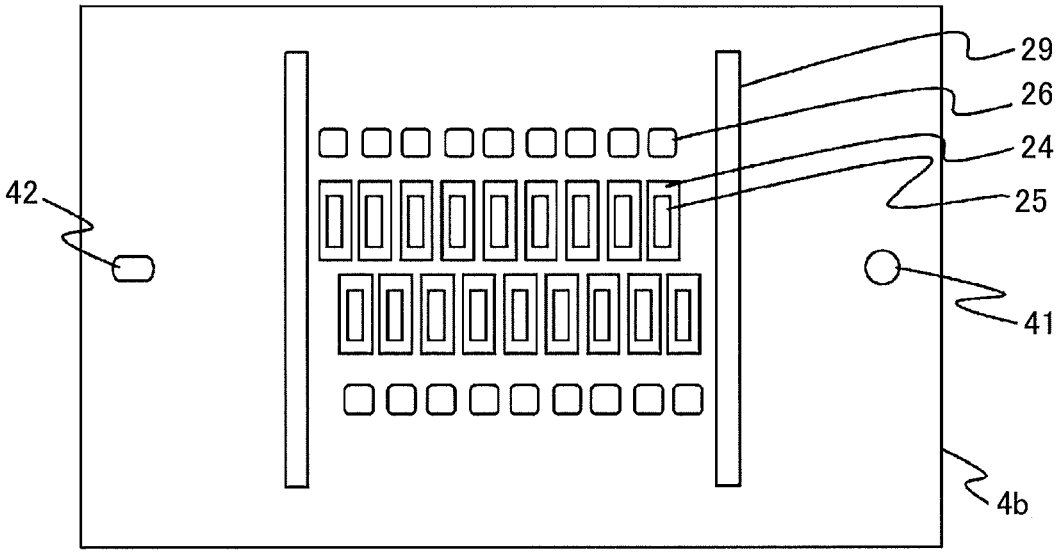
FIG. 14 is a plan view of a diaphragm plate constituting the liquid discharge head according to the still another embodiment.

FIG. 14 is a plan view of a diaphragm plate 4*b* according to the present embodiment. The diaphragm plate 4*b* is a component on which the damper plate 5*b* is laminated. The diaphragm plate 4*b* forms an air communication channel 29 communicating the air release chamber 28 of the damper plate 5*b* with air. The air communication channel 29 is formed along a short direction of the diaphragm plate 4*b* and is formed in a direction orthogonal to a direction in which communication holes 26 and diaphragms 24 are arranged so as to correspond to nozzles 20. By disposing the air communication channel 29 outside the nozzle row like the diaphragm plate 4*b*, it is possible to reduce an influence of reduced rigidity on an individual chamber as much as possible.

The liquid discharge head 1*b* according to the present embodiment can dispose the damper 27 below a filter 33 while reducing the number of components without lowering rigidity of the components constituting the individual chamber. With such a configuration, the liquid discharge head 1*b* can be formed with a small number of components, and the damper 27 can be disposed on an upstream side of the individual chamber without lowering rigidity of the components constituting the individual chamber. As a result, it is possible to suppress pulsation caused in the common chamber, and to reduce variation in discharge speed due to vibration of the components constituting the individual chamber.

Next, a liquid discharge device including a liquid discharge head and a liquid discharge apparatus according to an embodiment of the present invention will be described.

Figure 15:
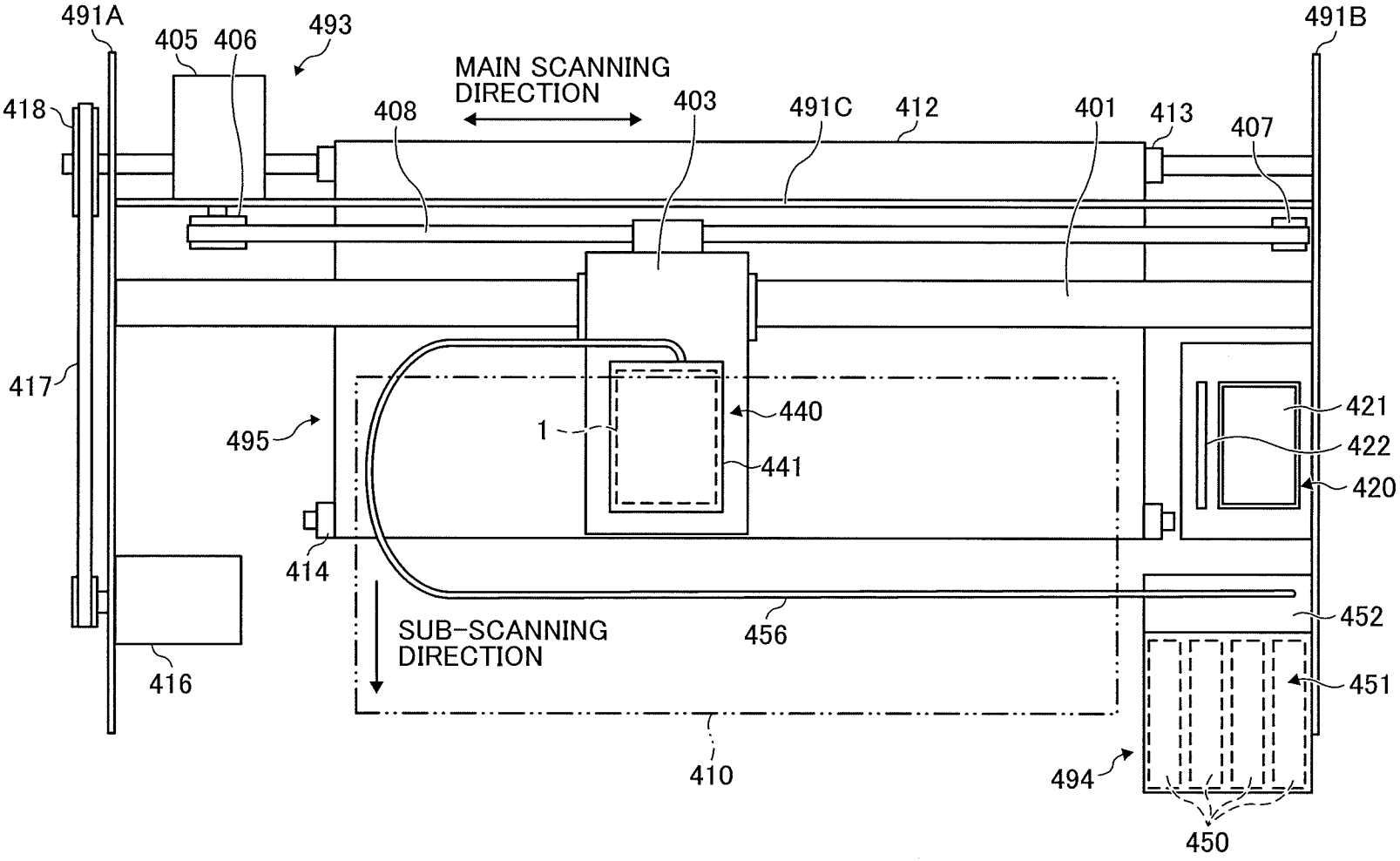
FIG. 15 is an explanatory plan view of a main part illustrating an example of a liquid discharge apparatus according to an embodiment of the present invention.
Figure 16:
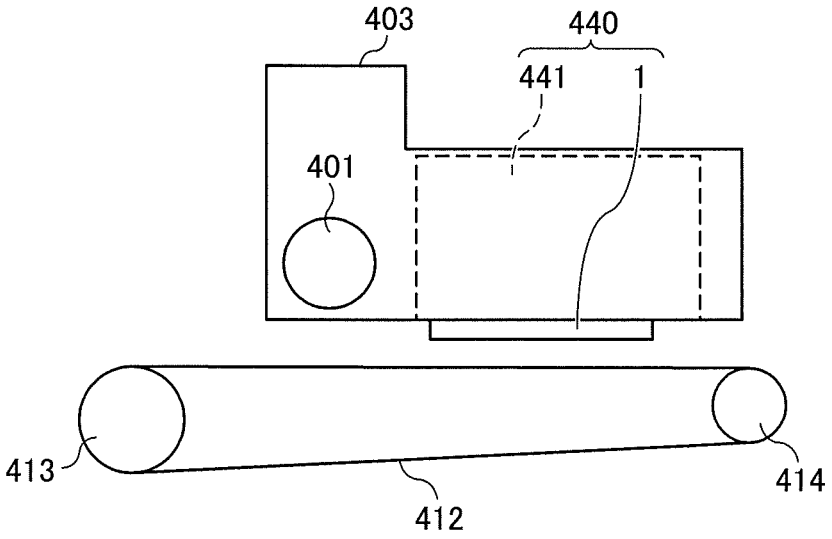
FIG. 16 is an explanatory side view of a main part illustrating another example of a liquid discharge apparatus according to an embodiment of the present invention.

First, a liquid discharge apparatus according to an embodiment of the present invention will be described with reference to FIGS. 15 and 16. FIG. 15 is an explanatory plan view of a main part of a liquid discharge apparatus 100 according to the present embodiment. FIG. 16 is an explanatory side view of a main part of the liquid discharge apparatus 100.

A serial type apparatus is exemplified as the liquid discharge apparatus 100. In the apparatus, a carriage 403 reciprocates in a main scanning direction by a main scanning movement mechanism 493. The main scanning movement mechanism 493 includes a guide member 401, a main scanning motor 405, a timing belt 408, and the like. The guide member 401 is stretched between left and right side plates 491A and 491B to movably hold the carriage 403. The main scanning motor 405 reciprocates the carriage 403 in the main scanning direction via the timing belt 408 stretched between a driving pulley 406 and a driven pulley 407.

The carriage 403 has a liquid discharge device 440 formed by integrating the liquid discharge head 1 having a damper structure, used in the present invention, with a head tank 441 mounted thereon.

The liquid discharge head 1 of the liquid discharge device 440 discharges liquids of colors, for example, yellow (Y), cyan (C), magenta (M), and black (K). The liquid discharge head 1 has a nozzle row including a plurality of nozzles disposed and attached in a sub-scanning direction orthogonal to the main scanning direction with a discharge direction downward.

A liquid stored in a liquid cartridge 450 is supplied to the head tank 441 by a supply mechanism 494 for supplying a liquid stored outside the liquid discharge head 1 to the liquid discharge head 1.

The supply mechanism 494 includes a cartridge holder 451 which is a filling unit for mounting the liquid cartridge 450, a tube 456, a liquid feeding unit 452 including a liquid feeding pump, and the like. The liquid cartridge 450 is detachably attached to the cartridge holder 451. A liquid is sent from the liquid cartridge 450 to the head tank 441 via the tube 456 by the liquid feeding unit 452.

The liquid discharge apparatus 100 includes a conveying mechanism 495 for conveying a sheet 410. The conveying mechanism 495 includes a conveying belt 412 as a conveying means and a sub-scanning motor 416 for driving the conveying belt 412.

The conveying belt 412 attracts the sheet 410 and conveys the sheet 410 at a position facing the liquid discharge head 1. The conveying belt 412 is an endless belt, and is stretched between a conveying roller 413 and a tension roller 414. Attraction can be performed by electrostatic attraction, air suction, or the like. The conveying belt 412 is rotated and moved in the sub-scanning direction by rotation driving of the conveying roller 413 via a timing belt 417 and a timing pulley 418 by the sub-scanning motor 416. Furthermore, on one side of the carriage 403 in the main scanning direction, a maintenance and recovery mechanism 420 for maintaining and recovering the liquid discharge head 1 is disposed on a side of the conveying belt 412.

The maintenance and recovery mechanism 420 includes, for example, a cap member 421 for capping a nozzle surface of the liquid discharge head 1 (a surface on which nozzles are formed), a wiper member 422 for wiping the nozzle surface, and the like.

The main scanning movement mechanism 493, the supply mechanism 494, the maintenance and recovery mechanism 420, and the conveying mechanism 495 are attached to a housing including the side plates 491A and 491B and the back plate 491C.

In the liquid discharge apparatus 100 having the above configuration, the sheet 410 is fed onto and attracted by the conveying belt 412, and conveyed in the sub-scanning direction by rotating movement of the conveying belt 412. Therefore, by driving the liquid discharge head 1 in accordance with an image signal while the carriage 403 is moved in the main scanning direction, a liquid is discharged onto the sheet 410 being stopped to form an image. In this way, the liquid discharge apparatus 100 includes the liquid discharge head used in the present invention, and therefore can stably form a high-quality image.

Figure 17:
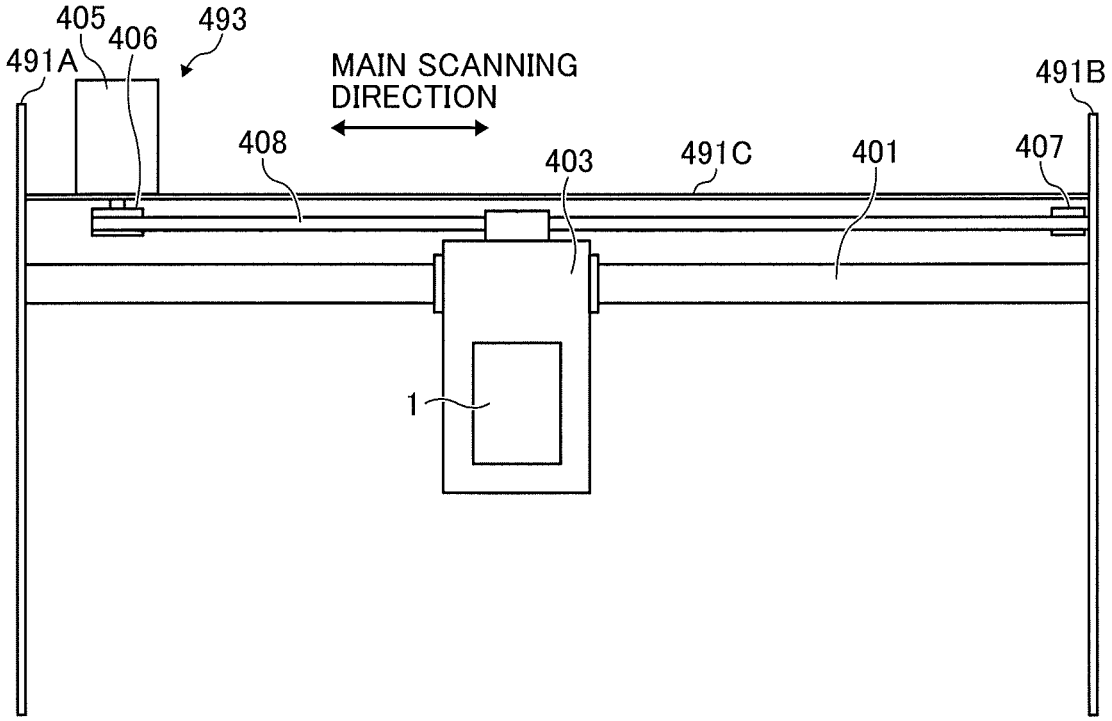
FIG. 17 is an explanatory plan view of a main part illustrating an example of a liquid discharge device according to an embodiment of the present invention.

Next, an example of a liquid discharge device according to an embodiment of the present invention will be described with reference to FIG. 17. FIG. 17 is an explanatory plan view of a main part of the liquid discharge device.

The liquid discharge device according to the present embodiment includes a housing portion including the side plates 491A and 491B and the back plate 491C, the main scanning movement mechanism 493, the carriage 403, and the liquid discharge head 1 out of the components constituting the liquid discharge apparatus 100 which is a liquid discharge apparatus. Note that it is also possible to form a liquid discharge device having at least either one of the above-described maintenance and recovery mechanism 420 and supply mechanism 494 further attached to, for example, the side plate 491B of the liquid discharge device.

Figure 18:
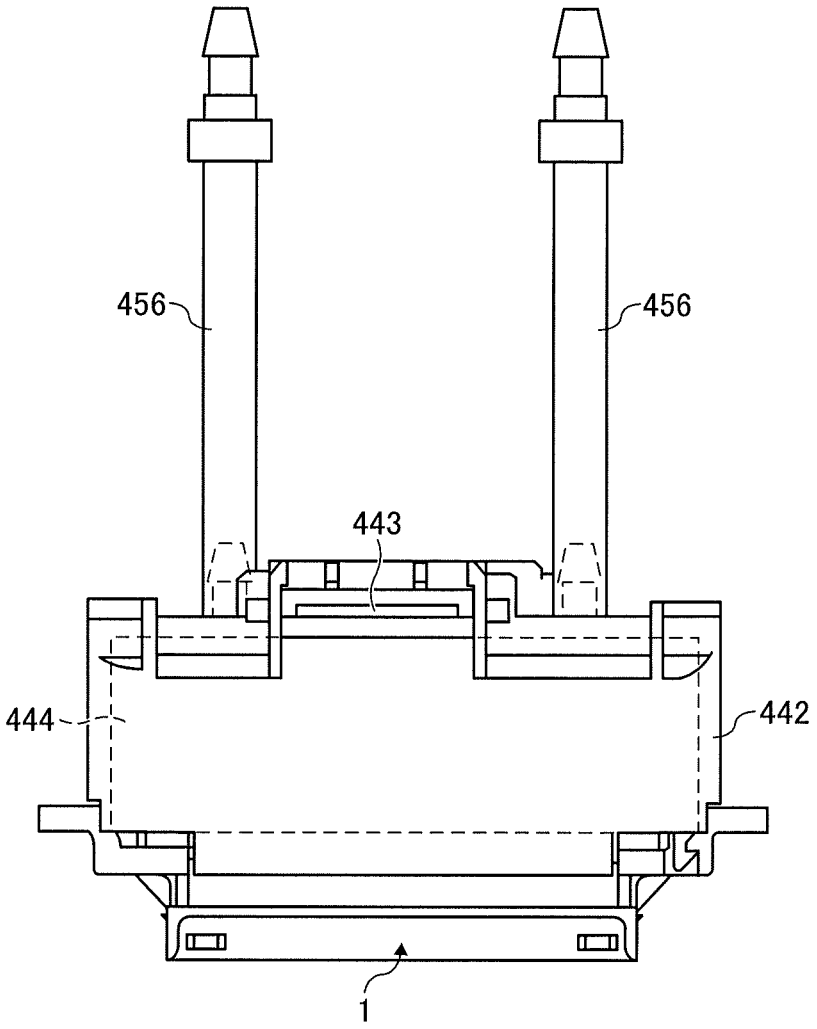
FIG. 18 is an explanatory front view illustrating another example of a liquid discharge device according to an embodiment of the present invention.

Next, another example of a liquid discharge device that can be mounted on a liquid discharge apparatus according to an embodiment of the present invention will be described with reference to FIG. 18. FIG. 18 is an explanatory front view of the liquid discharge device according to the present embodiment.

The liquid discharge device includes the liquid discharge head 1 having a channel component 444 attached thereto and the tube 456 coupled to the channel component 444. Note that the channel component 444 is disposed in a cover 442. Instead of the channel component 444, the head tank 441 can be included. A connector 443 for electrical connection with the liquid discharge head 1 is disposed on the channel component 444.

In the present invention described above, the "liquid discharge apparatus" includes a liquid discharge head or a liquid discharge device, and drives the liquid discharge head to discharge a liquid. The "liquid discharge apparatus" includes not only an apparatus capable of discharging a liquid onto a liquid-attachable object but also an apparatus for discharging a liquid toward a gas or a liquid.

The "liquid discharge apparatus" may also include a means related to feeding, conveying, or ejection of a liquid-attachable object, a pretreatment device, a post-treatment device, and the like.

Examples of the "liquid discharge apparatus" include an image forming apparatus for discharging an ink to form an image on a sheet and a stereoscopic modeling apparatus (three-dimensional modeling apparatus) for discharging a modeling liquid onto a powder layer obtained by forming a powder into a layer shape in order to model a stereoscopic modeled object (three-dimensional modeled object).

The "liquid discharge apparatus" is not limited to an apparatus in which a significant image such as a letter or a figure is visualized by a discharged liquid. Examples of the "liquid discharge apparatus" include an apparatus for forming a pattern or the like having no meaning by itself and an apparatus for modeling a three-dimensional image.

The "liquid-attachable object" means a material to which a liquid can be attached even temporarily. A material of the "liquid-attachable object" may be any material as long as a liquid can be attached to the object even temporarily, such as paper, yarn, fiber, cloth, leather, metal, plastic, glass, wood, or ceramics.

The "liquid discharge apparatus" includes both a serial type apparatus that moves a liquid discharge head and a line type apparatus that does not move the liquid discharge head unless otherwise specified.

Examples of the "liquid discharge apparatus" further include a treatment liquid application apparatus for discharging a treatment liquid onto a sheet in order to apply the treatment liquid to a surface of the sheet, for example, in order to modify the surface of the sheet, and a spraying granulation apparatus for spraying a composition liquid in which a raw material is dispersed in a solution via a nozzle to granulate fine particles of the raw material.

The "liquid discharge device" is formed by integrating a functional component and a mechanism with a liquid discharge head, and includes an assembly of components related to discharge of a liquid. Examples of the "liquid discharge device" include a device formed by combining at least one of configurations of a head tank, a carriage, a supply mechanism, a maintenance and recovery mechanism, and a main scanning movement mechanism with a liquid discharge head.

Here, examples of the integration include a case where a liquid discharge head, a functional component, and a mechanism are secured to each other by fastening, bonding, engagement, or the like and a case where one is held movably with respect to the other. A liquid discharge head, a functional component, and a mechanism may be detachable from each other.

Example of the liquid discharge device include a device in which a liquid discharge head and a head tank are integrated with each other like the liquid discharge device illustrated in FIG. 18. Example of the liquid discharge device further include a device in which a liquid discharge head and a head tank are coupled to each other with a tube or the like to be integrated with each other. Here, a unit including a filter may be added between the head tank of the liquid discharge device and the liquid discharge head.

Example of the liquid discharge device further include a device in which a liquid discharge head and a carriage are integrated with each other.

In addition, there is a liquid discharge device in which a liquid discharge head and a scanning movement mechanism are integrated with each other by movably holding the liquid discharge head on a guide member constituting a part of a scanning movement mechanism. Example of the liquid discharge device further include a device in which a liquid discharge head, a carriage, and a main scanning movement mechanism are integrated with each other as illustrated in FIG. 16.

Example of the liquid discharge device further include a device in which a cap member as a part of a maintenance and recovery mechanism is secured to a carriage to which a liquid discharge head is attached to integrate the liquid discharge head, the carriage, and the maintenance and recovery mechanism with each other.

Example of the liquid discharge device further include a device in which a tube is coupled to a liquid discharge head to which a head tank or a channel component is attached to integrate the liquid discharge head and a supply mechanism with each other as illustrated in FIG. 16.

The main scanning movement mechanism also includes a single guide member. The supply mechanism also includes a single tube and a single loading unit.

A pressure generator used by the "liquid discharge head" is not limited. In addition to the piezoelectric actuator (a laminated type piezoelectric element may be used) as described in the above embodiments, a thermal actuator using an electrothermal transducer such as a heating resistor, an electrostatic actuator including a diaphragm and a counter electrode, and the like may be used.

Here, image formation, recording, letter printing, photograph printing, printing, modeling, and the like are all synonymous.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A liquid discharge head comprising:

a channel section to supply a liquid to a plurality of nozzles to discharge the liquid; and a driving section to cause the nozzles to discharge the liquid, wherein the channel section includes an individual chamber to supply the liquid to the nozzles and a common chamber to supply the liquid to the individual chamber, and a laminated portion of each of a plurality of plate-shaped components which are constituent components of the individual chamber does not have a cut-out portion in a portion corresponding to a bonding position of a damper member disposed between the individual chamber and the common chamber.

2. The liquid discharge head according to claim 1, wherein the common chamber is divided into an ink supply side and an individual chamber side by a filter.

3. The liquid discharge head according to claim 2, wherein the constituent components of the individual chamber include a nozzle plate having the nozzles formed therein, a chamber plate laminated on the nozzle plate and including a pressure chamber to cause the nozzles to discharge a liquid, and a diaphragm plate laminated on the chamber plate and including a diaphragm to change a volume of the pressure chamber under control of the driving section, and the damper member is laminated on the diaphragm plate to form a damper.

4. The liquid discharge head according to claim 3, wherein the damper member is constituted by a damper plate partially having a thin plate portion having a thin thickness, the thin plate portion functions as a damper, an air release chamber is located on a side of the thin plate portion facing the constituent components of the individual chamber, and an air communication channel is formed around the air release chamber.

5. The liquid discharge head according to claim 3, wherein the damper member includes a thin plate-shaped damper plate and a spacer plate laminated between the damper plate and the constituent components, an air release chamber and an air communication channel are formed in the spacer plate, and the damper plate facing the air release chamber functions as a damper.

6. The liquid discharge head according to claim 3, wherein a warped plate portion warped toward the individual chamber as a part of the damper member functions as a damper, and an air release chamber and an air communication channel are formed in the constituent components.

7. The liquid discharge head according to claim 2, wherein the damper member is constituted by a damper plate partially having a thin plate portion having a thin thickness, the thin plate portion functions as a damper, an air release chamber is located on a side of the thin plate portion facing the constituent components of the individual chamber, and an air communication channel is formed around the air release chamber.

8. The liquid discharge head according to claim 2, wherein the damper member includes a thin plate-shaped damper plate and a spacer plate laminated between the damper plate and the constituent components, an air release chamber and an air communication channel are formed in the spacer plate, and the damper plate facing the air release chamber functions as a damper.

9. The liquid discharge head according to claim 2, wherein a warped plate portion warped toward the individual chamber as a part of the damper member functions as a damper, and an air release chamber and an air communication channel are formed in the constituent components.

10. The liquid discharge head according to claim 1, wherein the constituent components of the individual chamber include a nozzle plate having the nozzles formed therein, a chamber plate laminated on the nozzle plate and including a pressure chamber to cause the nozzles to discharge a liquid, and a diaphragm plate laminated on the chamber plate and including a diaphragm to change a volume of the pressure chamber under control of the driving section, and the damper member is laminated on the diaphragm plate to form a damper.

11. The liquid discharge head according to claim 10, wherein the damper member is constituted by a damper plate partially having a thin plate portion having a thin thickness, the thin plate portion functions as a damper, an air release chamber is located on a side of the thin plate portion facing the constituent components of the individual chamber, and an air communication channel is formed around the air release chamber.

12. The liquid discharge head according to claim 10, wherein the damper member includes a thin plate-shaped damper plate and a spacer plate laminated between the damper plate and the constituent components, an air release chamber and an air communication channel are formed in the spacer plate, and the damper plate facing the air release chamber functions as a damper.

13. The liquid discharge head according to claim 10, wherein a warped plate portion warped toward the individual chamber as a part of the damper member functions as a damper, and an air release chamber and an air communication channel are formed in the constituent components.

14. The liquid discharge head according to claim 1, wherein the damper member is constituted by a damper plate partially having a thin plate portion having a thin thickness, the thin plate portion functions as a damper, an air release chamber is located on a side of the thin plate portion facing the constituent components of the individual chamber, and an air communication channel is formed around the air release chamber.

15. The liquid discharge head according to claim 1, wherein the damper member includes a thin plate-shaped damper plate and a spacer plate laminated between the damper plate and the constituent components, an air release chamber and an air communication channel are formed in the spacer plate, and the damper plate facing the air release chamber functions as a damper.

16. The liquid discharge head according to claim 1, wherein a warped plate portion warped toward the individual chamber as a part of the damper member functions as a damper, and an air release chamber and an air communication channel are formed in the constituent components.

17. A liquid discharge device comprising the liquid discharge head according to claim 1 integrated with at least one of:

a head tank to store a liquid to be supplied to a liquid discharge head;

a carriage on which the liquid discharge head is mounted;

a supply mechanism to supply a liquid to the liquid discharge head;

a maintenance and recovery mechanism to perform maintenance and recovery of the liquid discharge head; and a main scanning movement mechanism to move the discharge head in a main scanning direction.

18. A liquid discharge apparatus to discharge a liquid, the apparatus comprising the liquid discharge head according to claim 1.

* * * * *